US006729144B1

(12) United States Patent
Kupferman

(10) Patent No.: US 6,729,144 B1
(45) Date of Patent: May 4, 2004

(54) COMPACT REFRIGERATION APPARATUS

(76) Inventor: Christa M. Kupferman, 3023 Greenleaf Ave., Wilmette, IL (US) 60091

( * ) Notice: Subject to any disclaimer, the term of this patent is extended or adjusted under 35 U.S.C. 154(b) by 0 days.

(21) Appl. No.: 10/394,861

(22) Filed: Mar. 21, 2003

(51) Int. Cl.[7] ..... F25B 21/02; F25B 21/00; F25D 11/00; F17C 13/00

(52) U.S. Cl. ..... 62/3.6; 62/3.62; 62/3.7; 62/440; 62/457.9

(58) Field of Search ..... 62/3.6, 3.62, 3.7, 62/440, 441, 457.9, 259.2

(56) References Cited

U.S. PATENT DOCUMENTS 5,524,440 A 6/1996 Nishioka et al.
5,782,094 A 7/1998 Freeman
6,021,642 A 2/2000 Guinn
6,094,917 A 8/2000 Sundhar et al.
6,094,918 A 8/2000 Burbidge et al.
6,253,568 B1 7/2001 Peffley
6,385,991 B1 5/2002 Romanoasky
6,446,459 B1 9/2002 Sawhney et al.
6,484,512 B1 11/2002 Anderson

*Primary Examiner*—Chen Wen Jiang
(74) *Attorney, Agent, or Firm*—Lesavich High-Tech Law Group; Stephen Lesavich

(57) ABSTRACT

A compact refrigeration unit attachable to furniture, medicine cabinets, backpacks or other pre-existing objects. The compact refrigeration unit includes racks or shelves specifically designed to hold cosmetics or medicines includes a security mechanism to prevent un-authorized access an information input assembly, and a display assembly to input and display information such as dosage, frequency, expiration date, interactions, etc. about the cosmetics or medicines stored in the compact refrigeration unit.

22 Claims, 8 Drawing Sheets

COMPACT REFRIGERATION APPARATUS

FIELD OF THE INVENTION

This invention relates to a compact refrigerator. More specifically, it relates to a compact refrigeration apparatus attachable to pre-existing objects such as furniture, medicine cabinets, etc.

BACKGROUND OF THE INVENTION

Many people throughout the world use cosmetics and other types of make-up (hereinafter "cosmetics") on a daily basis. Such cosmetics are typically expensive, do not include preservatives and have a limited shelve life. However, in many instances, this shelf life can be extended by placing the cosmetics in a refrigerator.

In addition, many people throughout the world suffer from chronic or temporary medical problems that require daily doses of medicine, or voluntarily consume nutritional supplements such as vitamins, etc. Parents of infant children have to prepare formula for baby bottles, baby food and other baby products that require refrigeration. For simplicity, hereinafter medicines and nutritional supplements and baby related items will be referred to as "medicines."

For example, a diabetic may require daily doses of insulin or an individual may develop an infection that can be cured by a regiment of antibiotics. In many instances medications are in a format (e.g., a liquid) that must be refrigerated. In other instances, such medicines may also not include any preservatives and refrigeration may prevent the breakdown or decay of such medicines until they are consumed.

Cosmetics and medicines can be stored in a conventional refrigerator such as one used to store household food items. However, there are several problems associated with storing cosmetics and medicines in a conventional refrigerator. One problem is that storing cosmetics and medicines in a conventional refrigerator is not convenient to the individual that is using the cosmetics, as the cosmetics are typically applied in a bathroom or bedroom and the conventional refrigerator is typically located in a kitchen area. Individuals taking medication may be seriously ill, incapacitated, or just feeling not up to the task of going to the refrigerator in the kitchen to retrieve the medicine.

Another problem is that storing cosmetics and medicines in a conventional refrigerator presents safety problems. In many households there are small children or adults who cannot see clearly or cannot read. In such households the children or adults may accidentally access the cosmetics or medications and mistake them for a food product. There are typically not security mechanisms on conventional refrigerators.

Another problem is that a conventional refrigerator does not have racks or shelves that are specifically suited to store small bottles and containers that are typically used to store cosmetics and medicines. As a result, the cosmetics and medicines may fall off the shelves and be subject to breaking, creating a further safety hazard.

Yet another problem is that cosmetics and medicines may not be easily visible in a conventional refrigerator. Thus, the cosmetics or medicines may be overlooked or forgotten about until after their expiration date.

Yet another problem is that the amount of remaining medicines and cosmetics may be forgotten or overlooked in a conventional refrigerator. An individual may run out of such of medicines or cosmetics due to lack of visibility.

Cosmetics and medicines can be stored in small or compact refrigerators. However, such small or compact refrigerators require additional floor space, counter top space, or otherwise occupy space that can be used to store other objects or devices or for other activities.

There have been various attempts to provide solutions to some of these problems associated with storing and refrigerating cosmetics and medicines. For example, the following U.S. Patents describe attempts to provide small or compact refrigerators specifically for cosmetics or medicines.

U.S. Pat. No. 5,524,440, entitled "Compact Refrigerator for Cosmetics" to Kishioka, et al. discloses a small refrigerator which is used exclusively for storing cosmetic preparations or cosmetics or certain kinds of medicines. Particularly, it relates to a compact refrigerator for storing cosmetics in the compartment thereof.

U.S. Pat. No. 6,021,642, entitled "Cosmetic Storage and Refrigeration Unit" to Guinn discloses a cosmetic storage and refrigeration unit that is a coolant cabinet that will increase the life expectancy of various cosmetic and beauty products stored and refrigerated therein. It is also designed to store products that have medical and nutritional value which require refrigeration.

U.S. Pat. No. 6,385,991, entitled "Refrigeration Apparatus" to Romanosky discloses a refrigeration apparatus for allowing a user to keep cosmetic items cool and protected from the environment and including a turntable that is adapted for rotating cosmetics and medicines.

There have also been attempts to provide compact refrigerators for storing other items such as cigars or cookies as described in U.S. Pat. Nos. 5,782,094, 6,094,917 and 6,122,918.

However, these inventions still do not solve all of the problems associated with refrigerating cosmetics and medicines.

There also have been some attempts to make refrigeration units more convenient by associating them with furniture. The following U.S. Patents describe attempts to provide refrigerators associated with furniture such as drawers.

U.S. Pat. No. 6,253,568, entitled "Refrigerator with Enhanced Freeze Compartment Access" to Peffley discloses a refrigerator with enhanced freezer compartment access for slidably receiving a frame into the freezer compartment. The refrigerator with enhanced freezer compartment access includes a refrigerator.

U.S. Pat. No. 6,446,459, entitled "Compact Refrigerator" to Sawhney et al. discloses a compact refrigerator that has an insulated enclosure for the cooling and temporary storage of items, a content storage drawer that is fully exposed by pulling open the drawer from the insulated enclosure. Access to the entire content space is by first pulling the ergonomically designed handle.

U.S. Pat. No. 6,484,512, entitled "Thermoelectric Temperature Controlled Drawer Assembly" to Anderson et al. discloses a temperature controlled drawer assembly incorporates a thermoelectric device and a control system to selectively heat or cool the contents of a drawer which is selectively movable into and out of a cabinet designed to be part of an end table, such as a nightstand, or other cabinet remote from a household kitchen.

However, these inventions still do not solve all of the problems associated with providing refrigerators associated with furniture for storing cosmetics or medicines.

Thus, it is desirable to provide a compact refrigeration unit that can be attached to existing objects such as furniture, medicine cabinets, or other objects that can be used to store cosmetics or medicines. The compact refrigeration unit should be easily attachable to existing objects and include racks or shelves specifically designed to hold cosmetics or medicines and include a security mechanism to prevent un-authorized access. It should also have a display that allows information about the cosmetics or medicines stored therein to be readily available.

SUMMARY OF THE INVENTION

In accordance with preferred embodiments of the present invention, some of the problems associated with storing cosmetics and medicines in refrigerators are overcome. A compact refrigeration unit attachable to pre-existing objects is presented.

The compact refrigeration unit includes racks or shelves specifically designed to hold cosmetics or medicines. It also includes a security mechanism to prevent unauthorized access, an information input assembly to input information (e.g., dosage, expiration date, etc.) about the cosmetics and medicines stored within the refrigerator and provides a display assembly to present information (e.g., dosage, expiration date, etc.) about the cosmetics or medicines stored within the refrigerator. The compact refrigeration unit may provide a more convenient way to securely refrigerate and store cosmetics and medicines.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Figure 1:
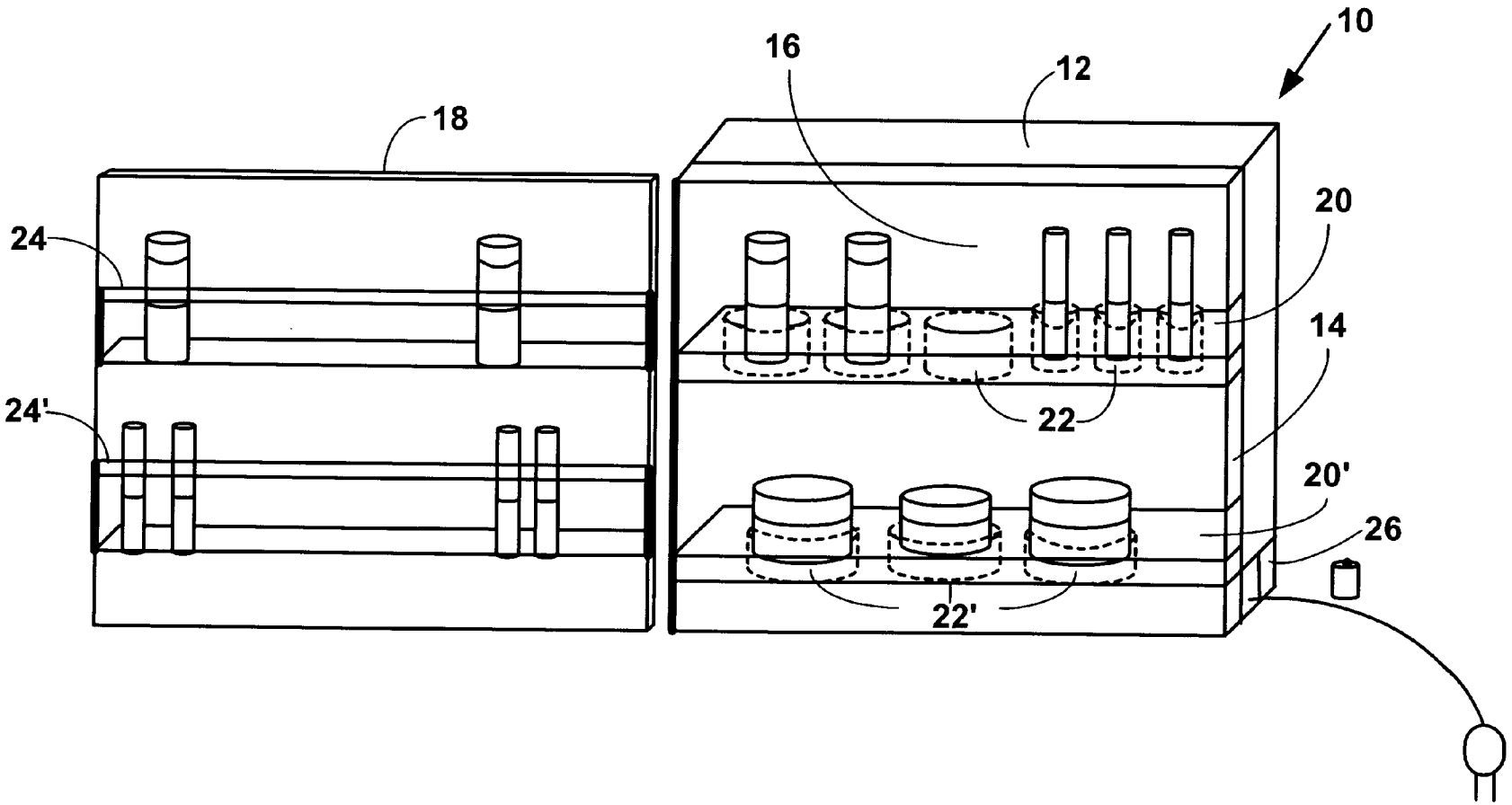
FIG. 1 is a perspective view illustrating a compact refrigeration unit with its door opened.

FIG. 1 is a perspective view illustrating a compact refrigeration unit 10. The compact refrigeration unit 10 is illustrated as a square shape. However, as is discussed below, the compact refrigeration 10 can be virtually any shape to match the size and shape of virtually any pre-existing object. The compact refrigeration unit includes a refrigeration assembly 12 for cooling and maintaining a predetermined temperature within an attached insulated cabinet 14. The compact refrigeration unit 10 including the refrigeration assembly 12 is a predetermined size and shape and color and is attachable to a pre-existing object of the same size and shape and color. For example, the refrigeration assembly 12 is the same size and shape as a pre-existing object such as a medicine cabinet, a nightstand, end table, coffee table, baby changing table, other types of furniture, a cosmetic box, jewelry box, the components of a wheelchair such as a wheelchair arm, a backpack or shoulder bag and many other existing objects. (See FIGS. 9–12). The refrigeration assembly 12 is a thin, light and compact refrigeration unit that runs on electrical power and/or battery power as is explained below.

The compact refrigeration unit 10 further includes an insulated cabinet 14 comprising plural insulated walls defining an interior space 16. One of the plural insulated walls includes the refrigeration assembly 12 and another one of the plural insulated walls includes a door 18 for accessing the interior space 16 of the insulated cabinet 14. The door 18 is attached to the insulated cabinet with a hinge assembly (not illustrated).

The insulated cabinet 14 includes one or more shelves 20 attached to the plural walls within the interior space 16 of the insulated cabinet 14 specifically sized, shaped and adapted for storing cosmetic and medicine containers. The one or more shelves 20 include plural depressions 22 of predetermined sizes and shapes specifically for storing cosmetic and medicine containers of various sizes and shapes.

In one embodiment of the present invention, the one or more shelves 20 include shelves comprising molded plastic. In another embodiment of the present invention, the one or more shelves 20 include shelves comprising metal wire coated with plastic or rubber. In another embodiment of the present invention, the one or more shelves 20 include shelves comprising light weight metals such as aluminum or light weight steel. Each of these embodiments include integral plural depressions 22.

For example, the plural depressions 22 include circular depressions of various sizes ranging in diameter from about five-eighth inches to about two and six-eighth inches includes to accommodate stock cosmetic bottles from about one-twenty-fourth ounces to about sixteen ounces for storing liquids, circular depressions of various sizes ranging in diameter from about five-eighth inches to about two and one-half inches to accommodate stock cosmetic jars from about one-half ounce to about four ounces for solids or powders, or circular depressions of other standard sizes used for stock cosmetic containers. The plural depressions 22 may also include circular depressions to accommodate standard size pill bottles ranging in diameter from about one to three inches.

The plural depressions 22 may also include, square, rectangular, oblong, oval trapezoidal, or other shape depressions used for nail polish, mascara, insulin and other types of cosmetic or medicine containers.

The insulated cabinet 14 also includes one or more storage racks 24 attached to one or more of the plural walls within the interior space 16, or on the door 18 also specifically sized, shaped and adapted for storing cosmetic and medicine containers. The one or more storage racks comprise plural horizontal components attached to at least two vertical components.

Selected ones of the plural horizontal components include built in holders for cosmetic and medicine containers. The spacing between the storage rack 24 horizontal components also includes spacing distances to accommodate bottles or jars for various types and sizes of cosmetic or medicine containers described above for the plural depressions 22.

For example, the spacing between the storage rack components include spacing of one fourth inch to three and one fourth inches to accommodate cosmetic and medicine components between one eighth and three inches. The compact refrigeration unit 10 further includes a power assembly 26 for providing an electrical power and battery power to the refrigeration assembly 12 as is described below.

Figure 2:
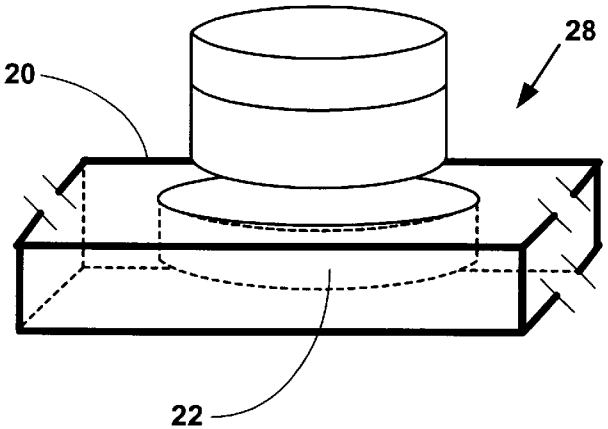
FIG. 2 is a perspective view illustrating a portion of an exemplary shelve with integral depression of the compact refrigeration unit of FIG. 1 in additional detail.
Figure 3:
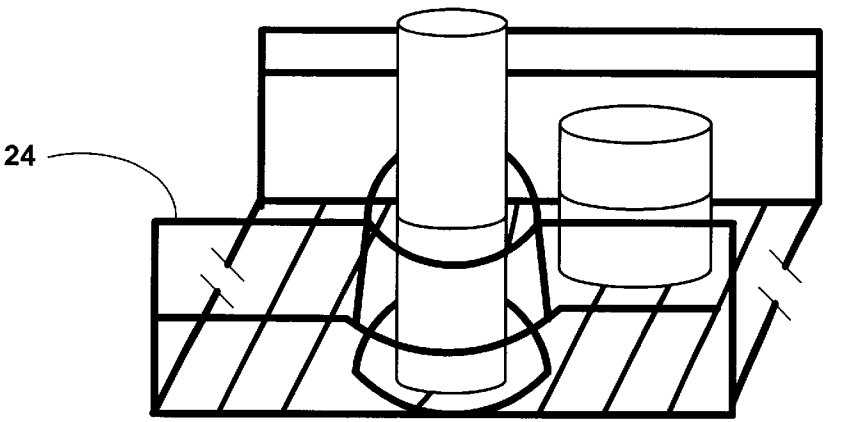
FIG. 3 is a perspective view illustrating an a portion of an exemplary rack of the compact refrigeration unit of FIG. 1 in additional detail.

FIG. 2 is a perspective view 28 illustrating a portion of an exemplary shelve 20 with circular integral depression 22 of the compact refrigeration unit 10 of FIG. 1 in additional detail. FIG. 3 is a perspective view 30 illustrating of portion of an exemplary rack 24 with container holder and rack spacing for containers of the compact refrigeration unit 10 of FIG. 1 in additional detail.

Figures 4, 5:
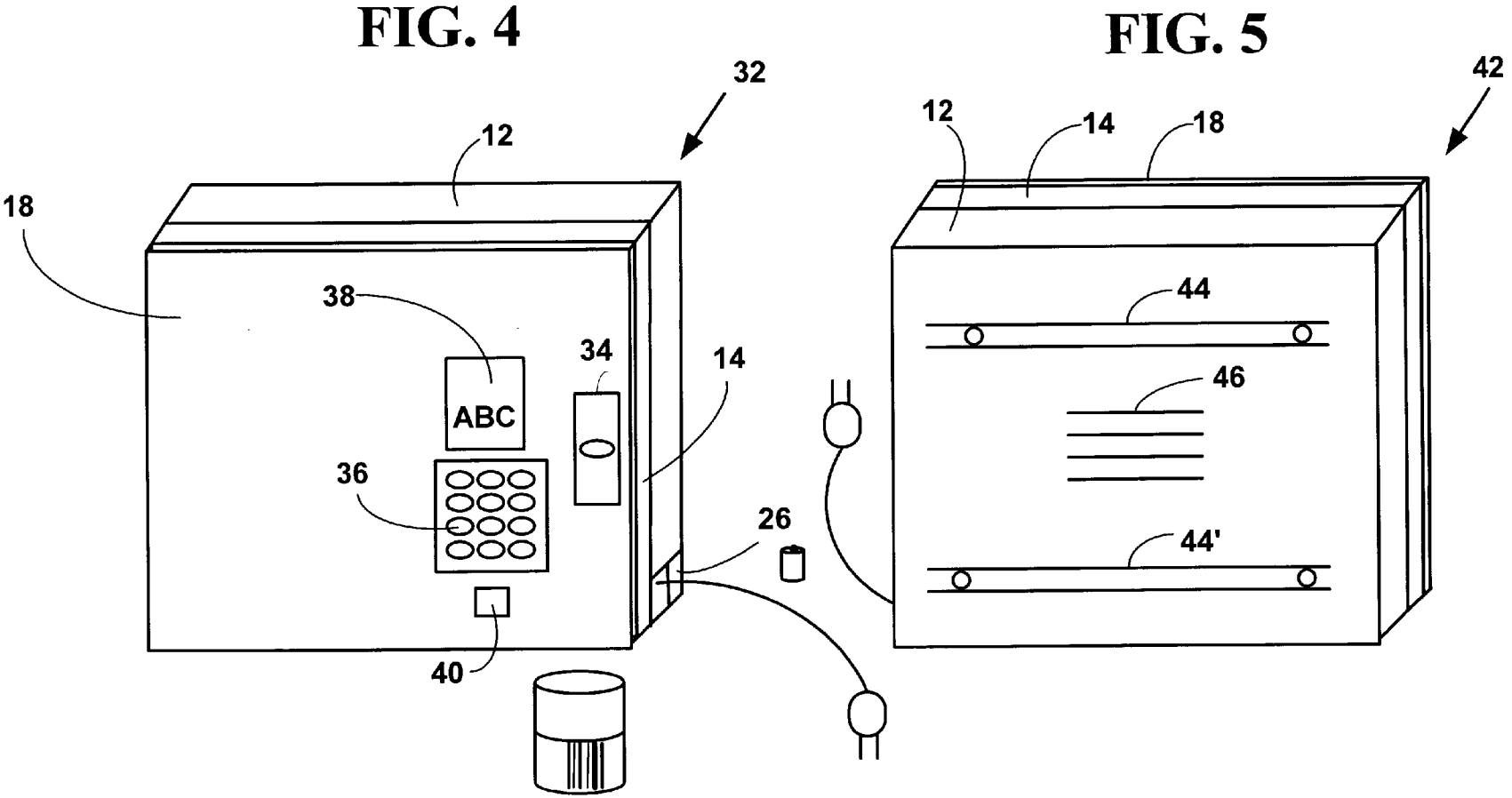
FIG. 4 is a front perspective view illustrating the compact refrigeration unit of FIG. 1 with its door closed.
FIG. 5 is a back perspective view illustrating the compact refrigeration unit of FIG. 1 with its door closed.

FIG. 4 is a front perspective view 32 illustrating the compact refrigeration unit 10 of FIG. 1 with its door 18 closed. The compact refrigeration unit 10 further includes an security assembly 34 attached to the door 18 for preventing unauthorized access to the insulated cabinet 14. In one embodiment of the present invention, the security assembly includes an electronic lock to prevent unauthorized access to the insulated cabinet.

In another embodiment of the present invention, the security assembly 34 includes a built-in mechanical lock and corresponding key (not illustrated). In another embodiment of the present invention, the security assembly includes a combination lock (not illustrated). However, other types of security assemblies 34 can also be used on the present invention is not limited to the security assemblies 34 described.

The compact refrigeration unit further includes an information input assembly 36 for entering alpha-numeric information. In one embodiment of the present invention, the information input assembly 36 includes an electronic keypad 36 for entering alpha-numeric information. The electronic keypad 36 includes a physical keypad, a graphical keypad displayed on a display screen, or other type of alpha-numeric keypad.

The electronic keypad 36 is used as an interface to enter display information about cosmetic or medicines products stored within the insulated cabinet 14 as is discussed below and can also be used as an interface to the security assembly 34 to enter an numeric or alpha-numeric combination.

The compact refrigeration unit 10 further includes a display assembly 38 attached to the door 18 of the insulated cabinet 14 for displaying information (type, dosage, frequency, expiration date, re-fills, etc.) associated with cosmetic and medicine containers stored within the interior space of the insulated cabinet 14.

In one embodiment of the present invention, the display assembly 38 is a monochrome liquid crystal display ("LCD") display. In another embodiment of the present invention, the display assembly 30 includes a color display such as super-twist nematic ("CSTN") or double layer color super-twist nematic ("DSTN") display.

In another embodiment of the present invention, the display assembly 38 includes an associated speaker (not illustrated). The speaker may be used as an audio information display for users that have vision problems and may not be able to view the display assembly 38 visually. For example, the speaker may be used to output generated audio sounds, or audio-visual information corresponding to information entered via the electronic keypad 36 or a universal product code reader used to scan bar codes included on the cosmetic and medicine containers as is explained below.

However, other types of electronic displays can also be used and the present invention is not limited to the electronic displays described. The electronic display assemblies 38 are used with the electronic keypad 36.

In another embodiment of the present invention, the display assembly 38 includes a markable board such as an electronic "white board" upon which notes can be written with a stylus, or a conventional "white board" upon which notes can be written with a marker (not illustrated). In another embodiment of the present invention, the display assembly 38 includes a replaceable note pad upon which notes can be written with a pen or pencil (not illustrated). However, the present invention is not limited to the display assemblies 38 described and other display assemblies can also be used.

The compact refrigeration unit 10 further includes a universal product code ("UPC") reader 40 integral to the door 18 of the insulated cabinet 14. As is known in the art, a UPC is a unique 12-digit number assigned to retail merchandise that identifies both the product and the vendor that sells the product. The UPC on a product typically appears adjacent to its "bar code," a machine-readable representation of the UPC.

The first six digits of the UPC are the vendor's unique identification number. All of the products that one vendor sells will have the same first six digits in their UPCs. The next five digits are the product's unique reference number that identifies the product within any one vendor's line of products. The last number is called the check digit that is used to verify that the UPC for that specific product is correct. The UPC also typically includes price information and may also be coded to include additional information such as dosage, expiration date, etc.

In such an embodiment, the UPC reader 40 is used to scan bar codes on cosmetic or medicine containers. The corresponding container information is stored in non-volatile storage such as flash memory, a flash drive, hard drive, or other non-volatile storage. Bar codes are read by a scanner in the UPC reader 40 that passes over the code and registers the UPC.

In one embodiment of the present invention, the UPC reader 40 is used to scan in information about the cosmetics or medicines in the cosmetic or medicine containers that are stored in the insulated cabinet 14. If the bar code does not include an expiration date, the corresponding expiration date can be manually input using the electronic keypad 36.

In another embodiment of the present invention, the compact refrigeration unit 10 further includes a network interface (not illustrated) to connect the refrigerator to a computer network such as the Internet, an intranet, or other network. In such an embodiment, the bar code information scanning in via the UPC reader 40 can be verified or supplemented via communications with a server on the computer network. Such communications may also be used to provide supplemental or other information, such as checking for adverse drug interactions that may be missed by the individual, to alert an individual of side-effects of a medicine, etc. The compact refrigeration unit 10 may also be linked to other servers or databases via its network interfaces such as physicians, hospitals, drug stores, etc.

The network interface includes a wired network interface such as a conventional modem, digital subscriber line ("DSL") modem, cable television ("CATV") modem, etc. The network interface may also include a wireless network interface such 802.11a, 802.11b, 802.11g, other wireless protocol interface in the 802.11X protocol family, or other wireless network interfaces.

FIG. 5 is a back perspective view 42 illustrating the compact refrigeration unit of FIG. 1 with its door closed. The compact refrigeration unit 10 includes one or more attachment assemblies 44 for attaching the compact refrigeration unit 10 to a pre-existing object. The attachment assemblies 44 include at least two horizontal members 44, 44' that attach to the compact refrigeration unit 10 as well as a pre-existing object. The attachment assemblies 44 also provide spacing for air circulation to and from air vents 46 for the compact refrigeration unit 10.

Figure 6:
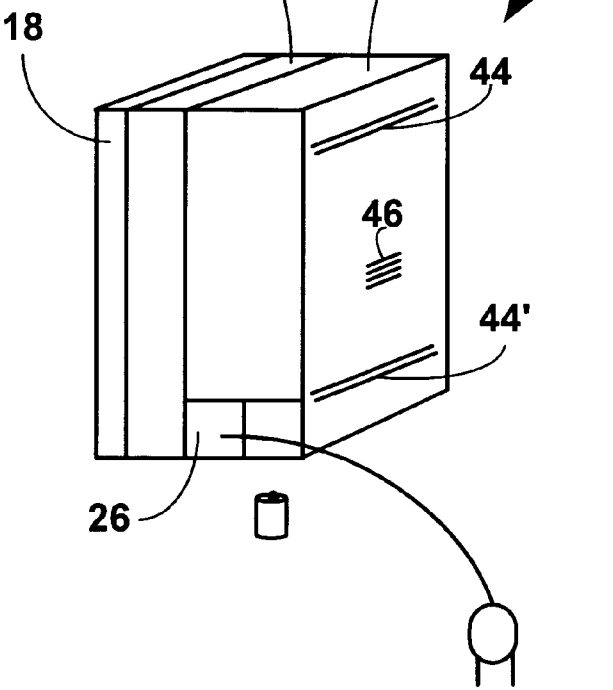
FIG. 6 is a side perspective view illustrating the compact refrigeration unit of FIG. 1 with its door closed.

FIG. 6 is a side perspective view 48 illustrating the compact refrigeration unit 10 of FIG. 1 with its door 18 closed. Components 34, 36, 38 and 40 have been described as being attached to the door 18 of the insulated cabinet 14. However, the present invention is not limited to attaching these components to the door 18 and these components can also be attached to another one of the plural insulated walls that comprise the compact refrigeration unit 10.

Figure 7:
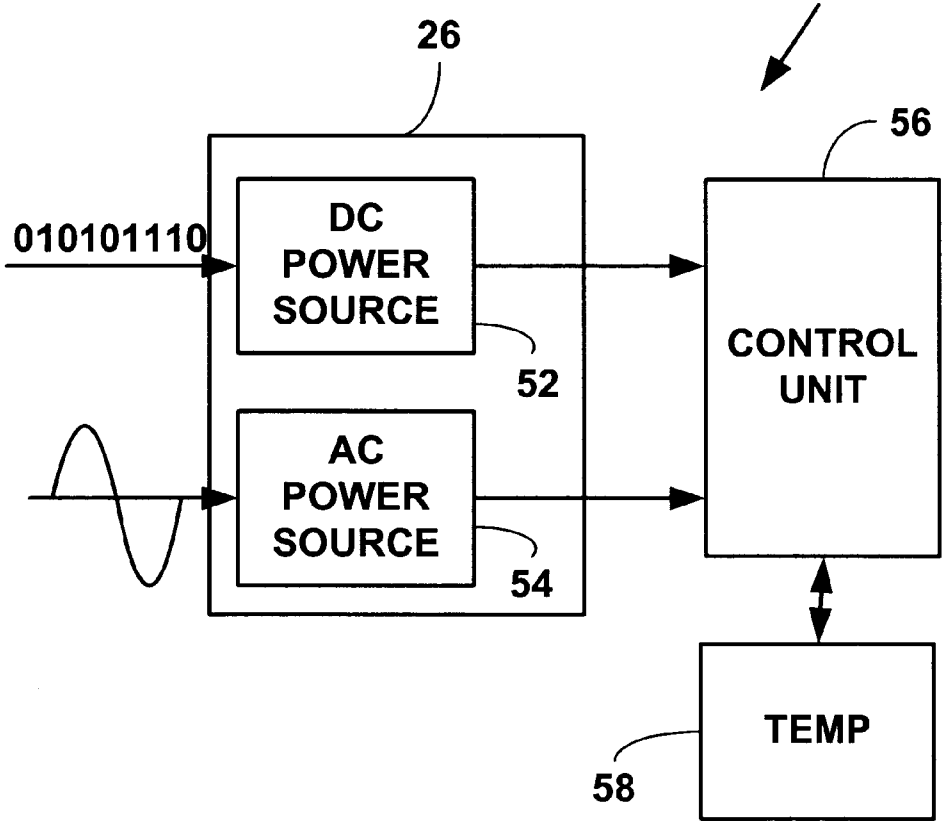
FIG. 7 is a block diagram illustrating an electrical circuit in a power assembly of the compact refrigeration unit of FIG. 1.

FIG. 7 is a block diagram illustrating an electrical circuit 50 for the power assembly 26. The power assembly 26 includes an electrical circuit 50 with first component 52 for providing electrical power from an alternating current ("AC") power source such as a 110 volt, 220 volt or other voltage AC power source. The power assembly 26 also includes a second component 54 for providing electrical power from a direct current ("DC") power source such as a battery.

In one embodiment, the battery is removabley mounted within the power assembly 26. In another embodiment, the second component includes an interface for a cable or chord that allows the second component of the power assembly 26 to be connected to an external battery. The second component 54 may include a DC power source for 12 volt automobile battery (e.g., accessed through a cigarette lighter), wheelchair battery, or a smaller battery of 4–8 volts, including rechargeable and non-rechargeable batteries such as those commonly used for video cameras, telephones, digital cameras, flashlights, or other types of small battery operated electronic devices.

The electrical circuit 38 also includes a third component 56 that is a control component that is used to control temperature circuitry 58 within refrigeration assembly 12 using an alternating or direct electrical current from first or second component 52, 54.

To illustrate the present invention, for example, the compact refrigeration unit 10 may be used in association with a medicine cabinet in a bathroom to provide convenient access to cosmetics and medicines without requiring an additional device that would occupy wall or counter space in the bathroom.

Compact refrigeration unit 10 has been described including components 12–58. However, the present invention is not limited to these components and more, fewer of other types of components can also be used on compact refrigeration unit 10.

Figure 8:
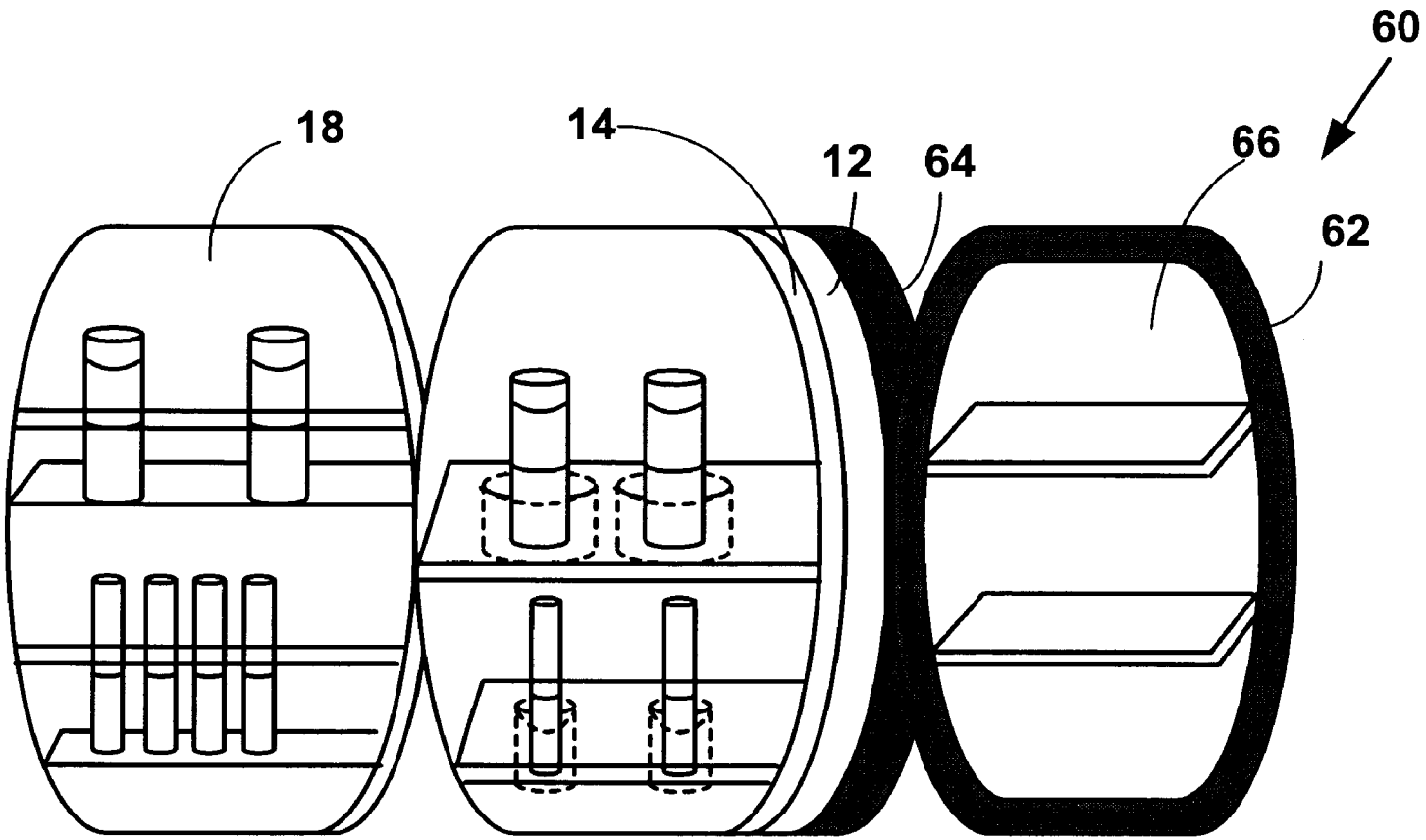
FIG. 8 is a perspective view illustrating a compact refrigeration unit with its door opened as part of a medicine cabinet.

FIG. 8 is a perspective view 60 illustrating a compact refrigeration unit 10 with its door 18 opened as part of a medicine cabinet 62. The medicine cabinet 62 is illustrated with a darker color to help distinguish it from the compact refrigeration unit 10. The compact refrigeration unit 10 typically is the same color as the object it is attached to. However, to help illustrate the present invention, the compact refrigeration unit 10 is illustrated with a light color, and the medicine cabinet 62 it is attached to is illustrated in a darker color.

The medicine cabinet 62 includes a door 64 and an interior storage space 66 with plural storage shelves. In FIG. 8, the medicine cabinet also has its door 64 opened. The compact refrigeration unit 10 is sized and shaped to match the size and shape of the medicine cabinet 62.

For example, the medicine cabinet 62 is illustrated with an oblong shape and may include a black coloring. The compact refrigeration unit 10 matches the oblong shape of the medicine cabinet 62 and would also include a black coloring that matches the medicine cabinet 62. However, as illustrated in FIG. 8, the compact refrigeration unit 10 includes a color different (i.e., white and not black) from medicine cabinet 62 to make it easier to illustrate the present invention. In addition, in this example, the compact refrigeration unit 10 would be attached to a power source in a vicinity of the medicine cabinet 62. In FIG. 8 the compact refrigeration unit 10 is attached to the door 64 of the medicine cabinet 62 and does not interfere with normal operation of the medicine cabinet 62.

Figure 9:
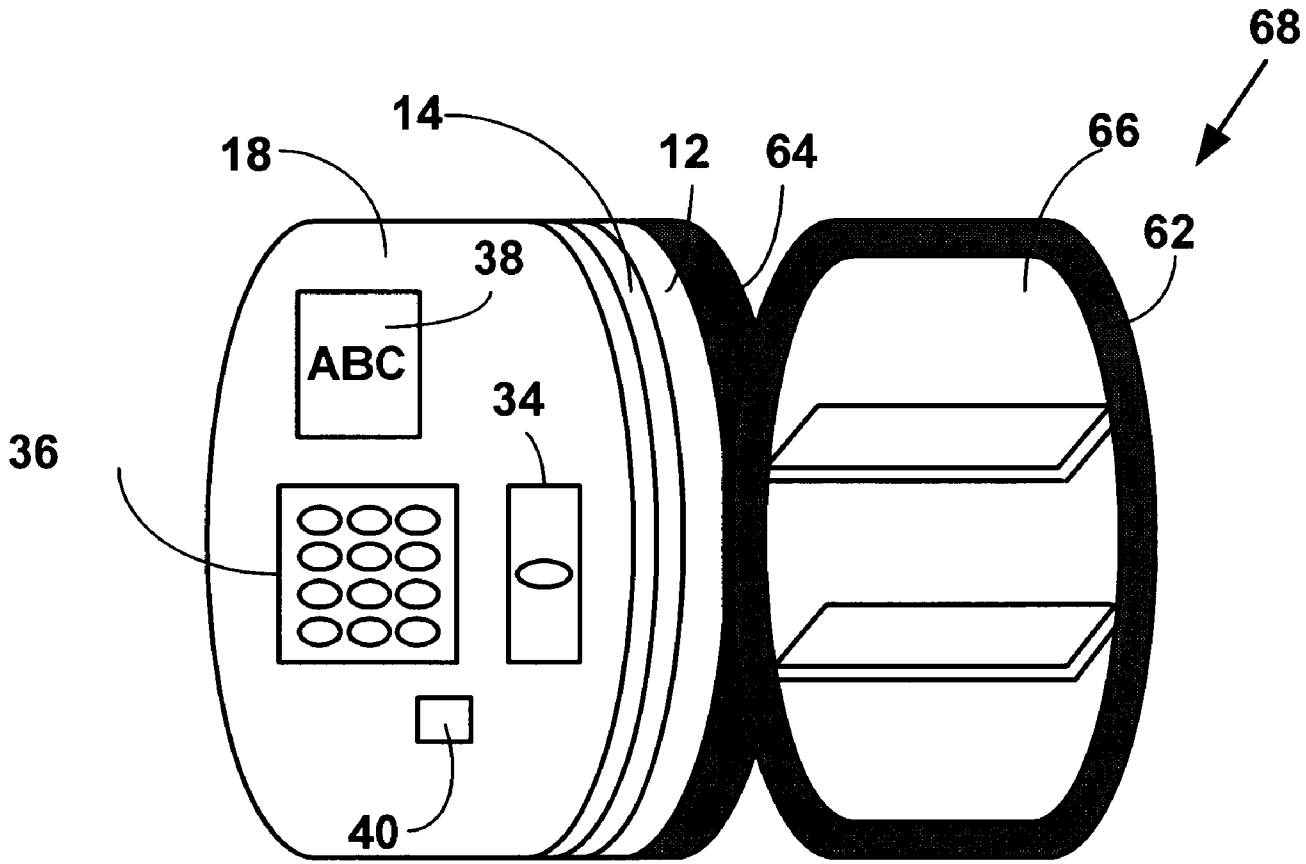
FIG. 9 is a perspective view illustrating a compact refrigeration unit with its door closed as part of a medicine cabinet.
Figure 10:
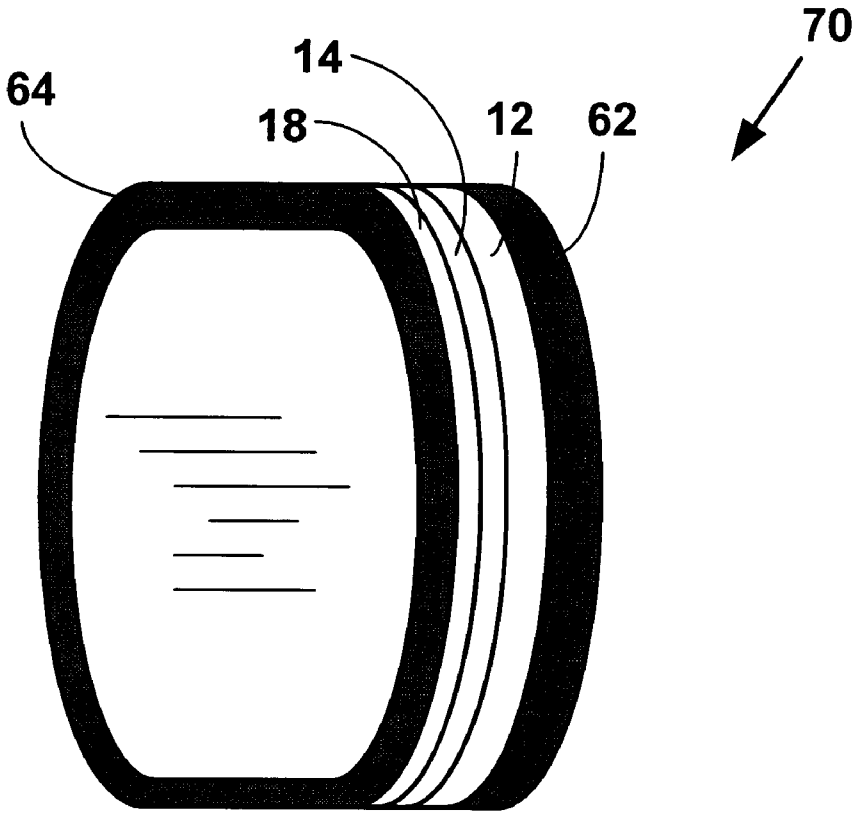
FIG. 10 is a perspective view illustrating a compact refrigeration unit as part of a medicine cabinet.

FIG. 9 is a perspective view 68 illustrating the compact refrigeration unit 10 with its door closed as part of the medicine cabinet 62. FIG. 10 is a perspective view 70 illustrating the compact refrigeration unit 10 as part of the medicine cabinet 62, wherein both the door 18 of the compact refrigeration unit 10 as well as the door 64 of the medicine cabinet are closed.

Figure 11:
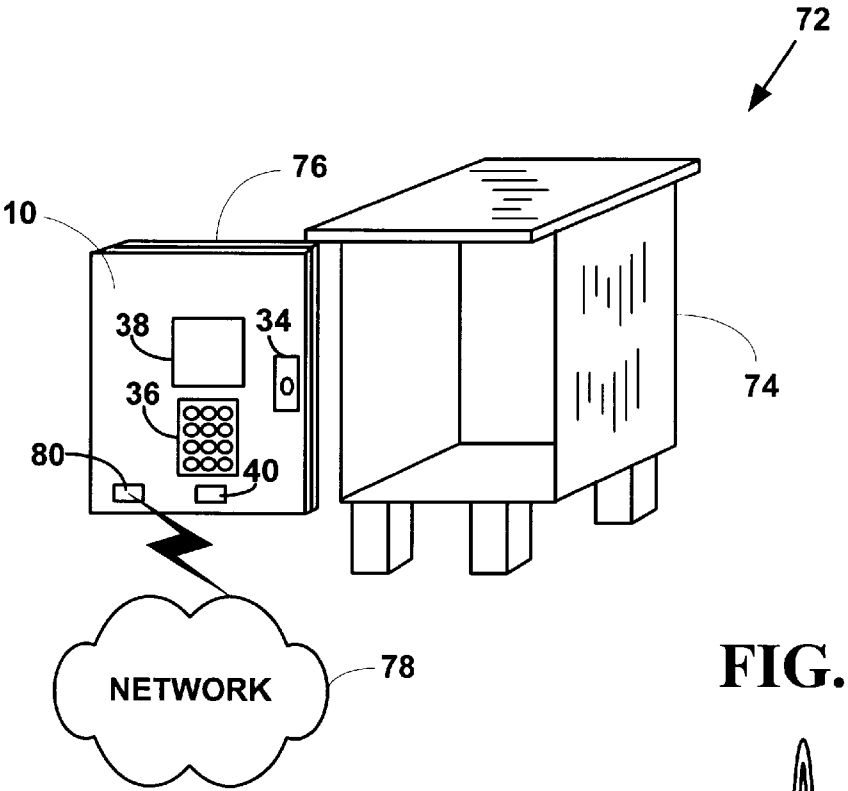
FIG. 11 is a perspective view illustrating a compact refrigeration unit as part of a nightstand.

FIG. 11 is a perspective view 72 illustrating a compact refrigeration unit 10 with its door 18 closed as part of a nightstand 74 with its door 76 open. The nightstand 74 includes a door 76 to which the compact refrigeration unit 10 is attached. The individual components and layers of the compact refrigeration unit 10 are not illustrated in FIG. 11 to simplify the drawing. The compact refrigeration unit 10 of FIG. 11 is connected to a computer network 78 via a network interface 80 to exchange information about the cosmetic and medicines stored within the cosmetic and medicine containers.

Figure 12:
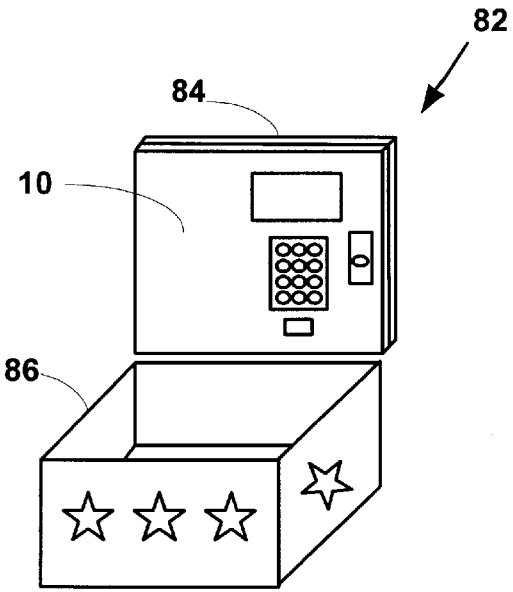
FIG. 12 is a perspective view illustrating a compact refrigeration unit as part of a cosmetic box.

FIG. 12 is a perspective view 82 illustrating a compact refrigeration unit 10 with its door 18 closed as part of a cosmetic box 84 with its door 86 open. The individual components and layers of the compact refrigeration unit 10 are not illustrated in FIG. 12 to simplify the drawing.

Figure 13:
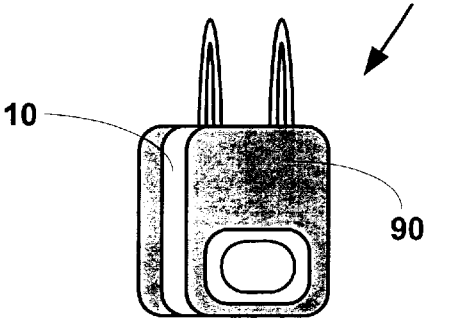
FIG. 13 is a perspective view illustrating a compact refrigeration unit as part of a backpack.

FIG. 13 is a perspective view 88 illustrating a compact refrigeration unit as part of a backpack 90. The individual components and layers of the compact refrigeration unit 10 are not illustrated in FIG. 12 to simplify the drawing. In such an embodiment, the individual components of the compact refrigeration unit 10 are accessed via zippered compartments associated with the backpack 90.

In FIGS. 11 and 12 the compact refrigeration unit 10 is attached to the doors 76, 80 respectively of the nightstand 74 and cosmetic box 82 respectively and does not interfere with normal operation of these objects. In FIG. 13, the compact refrigeration unit 10 is attached to the backpack 90 and does not interfere with its normal operation.

Thus, the compact refrigeration unit 10 provides a more convenient way to securely refrigerate and store cosmetics and medicines. The compact refrigeration unit 10 can be used to securely refrigerate and store cosmetics and medicines in warm climates. In such warm climates, the compact refrigeration unit 10 helps prevent cosmetics and medicines from melting and spoiling. It also allows cosmetics that are cooled to a desired temperature to be applied by a wearer to "refresh" the wearer in a warm climate.

The compact refrigeration unit 10 can also be used in remote and rural areas (e.g., by doctors or other medical personnel) with no electricity by operating the compact refrigeration unit 10 with battery power. In such areas the compact refrigeration unit 10 includes a portable battery power unit in the size and shape of a backpack, shoulder bag, or other non-rigid container that could be easily transported. The compact refrigeration unit 10 may also include a portable rigid container (e.g., in the size and shape of a brief case, etc.) that could be easily transported.

It should be understood that the architecture and apparatus described herein are not related or limited to any particular type of component unless indicated otherwise. Various types of general purpose or specialized components may be used with or perform operations in accordance with the teachings described herein. In view of the wide variety of embodiments to which the principles of the present invention can be applied, it should be understood that the illustrated embodiments are exemplary only, and should not be taken as limiting the scope of the present invention.

The claims should not be read as limited to the described order or elements unless stated to that effect. In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

I claim:

1. A compact refrigeration apparatus, comprising in combination:

a refrigeration means for cooling and maintaining a predetermined temperature within an attached insulated cabinet, wherein the compact refrigeration apparatus is a pre-determined size and shape and attachable to a pre-existing object of the pre-determined size and shape;

an insulated cabinet, comprising:

a plurality of insulated walls defining an interior space, wherein one of the plurality of insulated walls includes the refrigeration means and wherein another one of the plurality of insulated walls includes a door for accessing the interior space of the insulated cabinet;

one or more shelves attached to the plurality of walls within the interior space of the insulated cabinet specifically sized and adapted for storing cosmetic and medicine containers, and one or more storage racks attached to one or more of the plurality of walls within the interior space, specifically sized and adapted for storing cosmetic and medicine containers;

a power means for providing an electrical current to the refrigeration means;

a security means for preventing unauthorized access to the insulated cabinet;

an information input means for inputting information associated with cosmetics or medicines stored in cosmetic and medicine containers stored within the interior space of the insulated cabinet;

a display means attached to the door of the insulated cabinet for displaying information associated with cosmetic and medicine containers stored within the interior space of the insulated cabinet; and an attachment means for attaching the refrigeration means to the pre-existing object.

2. The compact refrigeration apparatus of claim 1 wherein the compact refrigeration apparatus has a pre-determined size and shape for a medicine cabinet, nightstand, end table, coffee table, baby changing table, cosmetic box, jewelry box, backpack, shoulder bag or wheelchair component.

3. The compact refrigeration apparatus of claim 1 wherein the one or more shelves include a plurality of integral depressions to receive a plurality of cosmetic and medicine containers.

4. The compact refrigeration apparatus of claim 3 wherein the one or more shelves with the plurality integral depressions include one or more shelves with a plurality of integral circular depressions with a diameter between six-eighth inches and three and one half inches to accommodate a plurality of different sized circular cosmetic and medicine containers.

5. The compact refrigeration apparatus of claim 3 wherein the one or more shelves with the plurality integral depressions include one or more shelves with a plurality of integral depressions with shapes including a plurality of circles, squares, rectangles, oblongs, ovals or trapezoids to accommodate a plurality of different shaped cosmetic and medicine containers.

6. The compact refrigeration apparatus of claim 1 wherein the one or more storage racks include one or more store racks with at least two vertical rack components and a plurality of horizontal rack components, wherein spaces between the plurality of horizontal rack components includes between six-eighths inches and three and one half inches to accommodate a plurality of different sized cosmetic and medicine containers.

7. The compact refrigeration apparatus of claim 1 wherein the one or more storage racks include one or more store racks with at least two vertical rack components and a plurality of horizontal rack components, wherein the plurality of horizontal rack components include built-in holders to accommodate a plurality of different sized and shaped cosmetic and medicine containers.

8. The compact refrigeration apparatus of claim 1 wherein the power means includes an alternating current and a direct current power means.

9. The compact refrigeration apparatus of claim 1 wherein the power means includes a removeable battery.

10. The compact refrigeration apparatus of claim 1 wherein the security means includes an electronic lock, combination lock or a mechanical lock with a corresponding key.

11. The compact refrigeration apparatus of claim 1 wherein the display means includes an electronic liquid crystal display.

12. The compact refrigeration apparatus of claim 1 wherein the information input means includes an alphanumeric keypad.

13. The compact refrigeration apparatus of claim 1 further comprising a universal product code reader for scanning in a bar code including encoded information about cosmetics and medicines stored within cosmetic and medicine containers stored within the insulated cabinet.

14. The compact refrigeration apparatus of claim 1 further comprising a network interface for connecting the compact refrigeration apparatus to a computer network to exchange information about cosmetics and medicines stored within cosmetic and medicine containers stored within the insulated cabinet.

15. The compact refrigeration apparatus of claim 1 further comprising a non-volatile storage means for storing information collected via the information input means.

16. A compact refrigeration apparatus, comprising in combination:

a refrigeration unit for cooling and maintaining a predetermined temperature within an attached insulated cabinet, wherein the compact refrigeration apparatus is a pre-determined size and shape and attachable to a pre-existing object of the pre-determined size and shape;

an insulated cabinet including a plurality of insulated walls defining an interior space;

one or more shelves attached to the plurality of walls within the interior space of the insulated cabinet including a plurality of integral depressions specifically sized and shaped for storing cosmetic and medicine containers;

one or more storage racks attached to one or more of the plurality of walls within the interior space including a plurality of holders specifically sized and shaped for storing cosmetic and medicine containers;

a lock for preventing unauthorized access to the insulated cabinet;

an alpha numeric keypad for inputting information associated with cosmetic and medicine containers stored within the interior space of the insulated cabinet;

an liquid crystal display attached to the door of the insulated cabinet for displaying information associated with cosmetic and medicine containers stored within the interior space of the insulated cabinet; and an attachment means for attaching the refrigeration means to the pre-existing object.

17. The compact refrigeration apparatus of claim 16 wherein the compact refrigeration apparatus has a predetermined size and shape for a medicine cabinet, nightstand, end table, coffee table, baby changing table, cosmetic box, jewelry box, backpack, shoulder bar or wheelchair component.

18. A compact refrigeration apparatus, comprising in combination:

a refrigeration unit for cooling and maintaining a predetermined temperature within an attached insulated cabinet, wherein the compact refrigeration apparatus is a pre-determined size and shape and attachable to a pre-existing object of the pre-determined size and shape;

one or more shelves attached to a plurality of walls within the insulated cabinet including a plurality of integral depressions specifically sized and adapted for storing cosmetic and medicine containers;

one or more storage racks attached to one or more of the plurality of walls within the insulated cabinet including a plurality of holders specifically sized and adapted for storing cosmetic and medicine containers;

an electronic lock for preventing unauthorized access to the insulated cabinet;

an alpha numeric keypad for inputting information associated with cosmetic and medicine containers stored within the insulated cabinet and for inputting a combination for the electronic lock;

a liquid crystal display for visually displaying information associated with cosmetic and medicine containers stored within the insulated cabinet;

a universal product code reader for scanning in a bar code including encoded information about cosmetics and medicines stored within cosmetic and medicine containers stored within the insulated cabinet;

a network interface for connecting the compact refrigeration apparatus to a computer network to exchange information about cosmetics and medicines stored within cosmetic and medicine containers stored within the insulated cabinet; and attachment brackets for attaching the compact refrigeration apparatus to the preexisting object.

19. The compact refrigeration apparatus of claim 18 wherein the compact refrigeration apparatus has a predetermined size and shape for a medicine cabinet, nightstand, end table, coffee table, baby changing table, cosmetic box, jewelry box, backpack, shoulder bag or wheelchair component.

20. The compact refrigeration apparatus of claim 18 further comprising a non-volatile storage means for storing information collected via the alpha numeric keypad, universal product code reader and network interface.

21. The compact refrigeration apparatus of claim 18 further comprising a speaker associated with the liquid crystal display for outputting audio information and audio visual information about cosmetics and medicines stored within cosmetic and medicine containers.

22. The compact refrigeration apparatus of claim 18 wherein the network interface includes a wireless network interface for connecting to a wireless network to exchange information about cosmetics and medicines stored within cosmetic and medicine containers stored within the insulated cabinet.

* * * * *